US011770889B2

(12) United States Patent
Gleich

(10) Patent No.: US 11,770,889 B2
(45) Date of Patent: Sep. 26, 2023

(54) FAST KVP SWITCHING EMPLOYING NON-LINEAR INDUCTANCE AND RESONANT OPERATION

(71) Applicant: KONINKLIJKE PHILIPS N.V., Eindhoven (NL)

(72) Inventor: Bernhard Gleich, Hamburg (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 38 days.

(21) Appl. No.: 17/795,038

(22) PCT Filed: Sep. 10, 2021

(86) PCT No.: PCT/EP2021/074952
§ 371 (c)(1),
(2) Date: Jul. 25, 2022

(87) PCT Pub. No.: WO2022/053622
PCT Pub. Date: Mar. 17, 2022

(65) Prior Publication Data

US 2023/0108815 A1 Apr. 6, 2023

(30) Foreign Application Priority Data

Sep. 14, 2020 (EP) ..... 20195940

(51) Int. Cl.
*H05G 1/58* (2006.01)

(52) U.S. Cl.
CPC ..... *H05G 1/58* (2013.01)

(58) Field of Classification Search
CPC ..... H05G 1/58
See application file for complete search history.

(56) References Cited

U.S. PATENT DOCUMENTS 2,160,605 A * 5/1939 Suits ..... H05G 1/52 315/284
4,589,123 A * 5/1986 Pearlman et al. ..... H05H 1/04 378/34
5,349,514 A 9/1994 Ushiki et al.
(Continued)

FOREIGN PATENT DOCUMENTS

WO 2014067915 A2 5/2014

OTHER PUBLICATIONS

Huisman H. et al., "Optimal Trajectory Control of a Series-Resonant Inverter with a Non-Linear Resonant Inductor", IEEE International Symposium on Predictive Control of Electrical Drives and Power Electronics (PRECEDE), pages 54-59, Sep. 2017.
(Continued)

*Primary Examiner* — Chih-Cheng Kao
(74) *Attorney, Agent, or Firm* — Larry Liberchuk

(57) ABSTRACT

The present invention relates to a system and a method for high-voltage switching for a computed tomography apparatus. The system comprises an oscillating circuit with a non-linear inductor and a capacitor. The inductor and the capacitor are connected in series, and the capacitor is connected to a high-voltage line of a high-voltage power supply. The inductor comprises an inductance that decreases with increasing current through the inductor, such that the inductance of the inductor significantly chances during a resonant operation of the oscillating circuit, thereby providing essentially a square voltage applied to the capacitor. The square voltage modulates the high-voltage of the high-voltage generator thus switching high-voltage levels applied to an electrode of a computed tomography system.

13 Claims, 9 Drawing Sheets

(56) References Cited

U.S. PATENT DOCUMENTS

| | | | |
|---|---|---|---|
| 8,836,463 | B2 | 9/2014 | Ikriannikov et al. |
| 9,627,125 | B2 | 4/2017 | Ikriannikov et al. |
| 2012/0155613 | A1 | 6/2012 | Caiafa et al. |
| 2014/0205070 | A1 | 7/2014 | Caiafa |

OTHER PUBLICATIONS

PCT International Search Report, International application No. PCT/EP2021/074952, Dec. 8, 2021.

* cited by examiner

FAST KVP SWITCHING EMPLOYING NON-LINEAR INDUCTANCE AND RESONANT OPERATION

FIELD OF THE INVENTION

The present invention relates to a system for high-voltage switching for a computed tomography apparatus, a computed tomography apparatus comprising the system for high-voltage switching, and a method for high-voltage switching for a computed tomography apparatus.

BACKGROUND OF THE INVENTION

Spectral imaging seems to become mainstream in X-ray computed tomography (CT). For spectral imaging, X-ray images of an object are acquired with at least two different peak energies of the X-ray radiation. This can be achieved by rapidly switching the high-voltage potential applied to the X-ray tube of the computed tomography apparatus. Switching of the peak high-voltage (kVp) may be an easy way for implementing spectral capabilities at low cost, and can provide efficient spectral imaging for all patients. Ultrafast kVp switching may be the simplest and most cost effective route for spectral CT while promising even better image quality than a double layer detector. Ultrafast switching retains the claim of the applicant of "spectral always on" if implemented correctly. There are several ways known to implement electronics that supports ultrafast kVp switching. However, many of these suffer from certain drawbacks like high cost or low fault tolerance. Thus, a solution is needed that is very cost effective and robust to all possible fault conditions, like tube arcing.

The inventors of the present invention have thus found that it would be advantageous to have a system and a method for high-voltage switching for a computed tomography apparatus that provides reliable and cost-efficient high-voltage switching.

SUMMARY OF THE INVENTION

It is an object of the present invention to provide a system and a method for high-voltage switching for a computed tomography apparatus that provides reliable and cost-efficient high-voltage switching and applies low stress to the electrode of the computed tomography apparatus.

The object of the present invention is solved by the subject matter of the independent claims, wherein further embodiments are incorporated in the dependent claims.

The described embodiments similarly pertain to the system for high-voltage switching for a computed tomography apparatus, the computed tomography apparatus comprising the system for high-voltage switching, and the method for high-voltage switching for a computed tomography apparatus. Synergistic effects may arise from different combinations of the embodiments although they might not be described in detail.

Further on, it shall be noted that all embodiments of the present invention concerning a method, might be carried out with the order of the steps as described, nevertheless this has not to be the only and essential order of the steps of the method. The herein presented methods can be carried out with another order of the disclosed steps without departing from the respective method embodiment, unless explicitly mentioned to the contrary hereinafter.

According to a first aspect of the invention, there is provided a system for high-voltage switching for a computed tomography apparatus. The system comprises a high-voltage generator, an inductor having a non-linear inductance, and a capacitor. A first connection terminal of the capacitor is communicationally connected to the high-voltage generator, and a second connection terminal of the capacitor is communicationally connected to a first connection terminal of the inductor for employing a resonant operation of a current through the inductor. The inductor is configured for providing a reduction of the non-linear inductance with an increasing current through the inductor, and the inductor is configured for providing the reduction of the non-linear inductance at a predefined current level of the current through the inductor below a maximum value of the current of the resonant operation.

The proposed system uses a resonant circuit, that is connected to a high-voltage outlet of the high-voltage generator. The resonant circuit comprises a capacitor and an inductor connected in series, thus enabling resonant operation. One connector of the capacitor is connected to the high-voltage outlet, and the other connector is connected to a first side of the inductor. The second side of the inductor can be connected to ground or to another outlet of the high-voltage generator. Communicationally connected has to be understood such, that a conductive connection between the respective elements is established. The resonant operation of the circuit results in a current through the inductor that is upheld by an inductance L of the inductor thus charging the capacitor. At maximum charge of the capacitor, the current direction through the inductor changes and the capacitor is decharged. In case an inductor providing a constant inductance is used, a sine wave-form of current through the inductor and voltage at the capacitor, respectively, is provided. However, the application of spectral imaging may not require a sine wave-form of the voltage, but a square-like voltage. In the present application, the square-like waveform of the voltage is not achieved by employing switches in the resonator, but by using a non-linear inductor. The non-linear inductor provides an inductance, that is dependent from the current through the inductor. At low current values below a predefined current level, and thus at a high charge of the capacitor, a high inductance of the inductor limits the current to preferably less than 500 mA. This comparably low current leads to an essentially constant charge of the capacitor and therefore provides a nearly constant voltage level of the capacitor. However, when the current through the inductor increases above the predefined current level, the inductor is configured to automatically reduce its inductance significantly. Preferably, the inductance is reduced by at least a factor of 100. However, a small inductance has to remain to maintain the resonant operation. This steeply decreased inductance allows an abrupt increase of the current to preferably several tens of Ampere, thus leading to a quick discharge of the capacitor and a quick recharge in the opposite direction. At the time the current of the resonant operation falls below the predefined current level, the inductor is configured to automatically restore its high inductance and again limits the current to preferably less than 500 mA, resulting a at nearly constant voltage at the capacitor at a different voltage level. Therefore, the system of the present invention provides a square-like voltage applied at the capacitor that is achieved by employing a resonant operation with a non-linear inductance of an inductor.

In an embodiment of the invention, the inductor comprises a magnetic core that is configured for magnetically saturating at the predefined current level.

The inductor can comprise a magnetic core that saturates at low field strength. There are many materials suitable for the task, notably monocrystalline or amorphous soft magnetic alloys can be used. Providing the inductor with a magnetic core that saturates at a predetermined field strength causes the inductance of the inductor to drop at the same time the magnetic core reaches saturation. The magnetic field that results in saturation of the magnetic core can be caused by the current through the inductor.

In an embodiment of the invention, the inductor is configured for providing a first inductance in case the current through the inductor is below the predefined current level and a second inductance in case the current through the inductor is above the predefined current level, and the second inductance is smaller than the first inductance by a factor of at least 100.

The steep drop of the inductance of the inductor close to the predefined current level results in different values of the inductance below and above the predefined current level, respectively. A ration of the first inductance to the second inductance is at least about 100 in this embodiment of the invention, and can be as big as 10000 or even more. However, the dependency of the inductance over the current will be a continuos function. In addition, the inductance will comprise also slight variations if the current through the inductor is clearly below or clearly above the predefined current level. Thus, the first inductance can be interpreted as a mean value of the inductance for the current being sufficiently small compared to the predefined current level, and the second inductance can be interpreted as a mean value of the inductance for the current being sufficiently big compared to the predefined current level.

In an embodiment of the invention, the system is configured for providing in the resonant operation a voltage applied at the capacitor that is essentially constant at a first voltage level or at a second voltage level in case the current through the inductor is below the predefined current level, and the voltage applied at the capacitor rapidly changes from the first voltage level to the second voltage level or from the second voltage level to the first voltage level in case the current through the inductor is above the predefined current level.

The voltage applied at the capacitor changes its voltage level rapidly from the first voltage level to the second voltage level and vice versa at the times the inductance has its lower value. During the timespan the inductance of the inductor has its higher value and thus the current through the inductor is below the predefined current level, the voltage at the capacitor is nearly constant at either the first or the second voltage level. Thus, a plateau of the voltage can be provided.

In an embodiment of the invention, the voltage applied at the capacitor is essentially a square voltage.

These plateaus of the voltage applied at the capacitor at two different voltage levels with abrupt transition from one voltage level to the other in a very short timespan leads to a square voltage. The square voltage has the advantage that the voltage is at a constant level for most of the time, which enables the computed tomgraphy apparatus to take data at most of the times. As there is a smooth and continuous transition from one voltage level to another due to the non-linear inductance, there is a low rate of high frequencies applied to the X-ray tube during high-voltage switching. This leads to lower stresses on the X-ray tube and can result in a more reliable operation of the computed tomography apparatus.

In an embodiment of the invention, the inductor is configured to provide a non-linear inductance, wherein a first dependency of the inductance from the current in a first direction of the current though the inductor is different from a second dependency of the inductance from the current in a second direction of the current through the inductor, wherein the first direction is opposite to the second direction, and/or wherein the system is configured for providing a voltage applied to the capacitor that is essentially an asymmetric square voltage.

For employing a duty cycle adapted to the needs of the computed tomography apparatus, a square-like voltage may be needed with an asymmetric waveform. With an asymmetric waveform, the time of the voltage being on the first voltage level may be different from the time of the voltage being on the second voltage level. This can be achieved by providing an inductor with a non-linear inductance and a different behavior in positiv and negativ current direction. For example, the inductor can be configured to provide a separate predefined current level for each of the current directions, wherein the first predefined current level is different form the second predefined current level. Alternatively, the inductor can be configured to provide different values of the first inductance and/or the second inductance in the positiv and negativ current direction, respectively.

In an embodiment of the invention, the inductor comprises a first inductor having a non-linear inductance, a second inductor having a non-linear inductance and connected in series to the first inductor, and a diode configured to act as rectifier and/or connected in parallel to the first inductor or to the second inductor.

To get the right duty cycle, a diode may be used to operate at least one of at least two inductors only in one current direction. In this embodiment of the invention, the effective inductance of the inductor comprising a first inductor and a second inductor connected in series is changed in one current direction, as one of the inductors is short-circuited by the diode.

In an embodiment of the invention, the system comprises a biasing device configured to expose the inductor to an external magnetic field or wherein the system comprises a biasing circuit configured to cause a DC bias current through the inductor.

As an alternative, the saturation of the core may be modulated by a switched current source that acts on additional windings of the non-linear inductor. By biasing the inductor with an external magnetic field, saturation of the inductor, specifically of a core of the inductor, can be achieved at a different current level through the inductor. As this external magnetic field does not change its direction with the changing current direction through the inductor, the sum of the external magnetic field and the magnetic field caused by the current through the inductor is different in the first and the second current direction, respectively. Thus, the predefined current level is different for positiv and negativ current direction. Alternatively, the system can be provided with a biasing circuit configured to cause a DC current through the inductor, that is summed up with the alternating current of the resonant operation through the inductor. Thus, the resulting current through the inductor is different in the first and the second current direction, thus providing a different behavior of the inductance with the current of the resonant operation in positive and negative current direction, respectively. Thus DC current may be provided by an amplifier connected to a relatively large linear inductor, that ensures a current through the biasing circuit with an amplitude that is not significantly changing over one periode of the resonant operation.

In an embodiment of the invention, the system comprises an adjustment mechanism configured to adjust a resonance frequency of the resonant operation.

For synchronizing the switching of the high-voltage with a rotation frequency of an X-ray tube of the computed tomography apparatus, the system may need to be configured for providing an adjustable resonance frequency. This can be ensured by an adjustment mechanism configured to provide a possibility for adjusting at least one of the inductance of the inductor and the capacitance of the capacitor.

In an embodiment of the invention, the adjustment mechanism comprises at least one of a switchable capacitor, a tunable capacitor, a switchable inductor, or a tunable inductor.

For employing the adjustment mechanism, the system can be provided with a tunable or switchable capacitor, configured to adjust the capacitance of the capacitor. In addition or as an alternative, the system can be provided with a tunable or switchable inductor configured to adjust the inductance of the inductor. Thus, the resonance frequency of the resonant operation can be adapted to the specific needs of the computed tomography apparatus.

In an embodiment of the invention, the inductor comprises a first inductor having a non-linear inductance, and a second inductor having a non-linear inductance and connected in series to the first inductor, wherein the system comprises a first control inductor inductively coupled to the first inductor, and a second control inductor inductively coupled to the second inductor, wherein the system is configured to provide a first control current in the first control inductor and a second control current in the second control inductor, and wherein the first control current has a same amperage and an opposite direction to the second control current.

In this embodiment of the invention, adjustment of the resonance frequency of the resonant operation can be achieved by influencing the value of the predefined current level of the inductor. The inductor is separated into a first inductor and a second inductor connected in series. Each of the first inductor and the second inductor is provided with a respective control inductor inductively coupled to the first and the second inductor, respectively. By providing an adjustable current through the first control inductor and the second control inductor, that has the same size but an opposite current direction in the first control inductor and the second control inductor, respectively, the resonance frequency can be adjusted. The opposite current directions in the control inductors provide good decoupling and symmetric behavior of the circuit in both current directions of the resonant operation. Thus, the influencing of the resonant operation may be performed with either direct current through the first and second control inductor, or with alternating current that has the same frequency as the resonance frequency of the resonant operation.

In an embodiment of the invention, the system comprises a driving mechanism configured to excite the resonant operation.

For exciting and driving the resonant operation of a current through the inductor, an external input may be necessary. This external input excites the current and provides energy supply to maintain the resonant operation, if the driving mechanism is controlled at the resonance frequency.

In an embodiment of the invention, the driving mechanism comprises switching of the high-voltage generator, or the driving mechanism comprises an amplifier inductively coupled to the inductor or capacitively coupled to the capacitor.

For exciting and driving the resonant operation of the system, an oscillation of the high-voltage of the high-voltage generator can be used. However, this may be very inconvenient. Thus, in this embodiment of the invention, a driving mechanism is provided, that is comprised in the system. This driving mechanism comprises an amplifier for generating an alternating current. The driving mechanism can be inductively coupled to the inductor, or at least to a first or a second inductor of the inductor. Thus, the alternating current of the driving mechanism will induce an alternating current of the resonant operation through the inductor of the system, if the frequency of the driving mechanism is properly adjusted. However, the driving mechanism can also be coupled to the system capacitively, resistively at various feed points or inductively by using a dedicated transformer. This amplifier may also be used to adjust the resonance frequency to the exact desired value.

In an embodiment of the invention, the system further comprises a smoothing inductor, wherein the first connection terminal of the capacitor is connected to the high-voltage output of the high-voltage generator via the smoothing inductor.

This additional inductor after the high voltage source provides a smoothing of the current provided by the high-voltage source and consumed by the X-ray tube by limiting changes of the current. The current of the resonator needs to charge the intrinsic capacitances of the whole system and the computed tomography apparatus during each cycle, thus, this smoothing inductor decreases the capacitance seen by the resonator, makes the voltage curves more predictable and reduces the designed power handling capability of the system.

According to another aspect of the invention, there is provided a computed tomography apparatus comprising the system according to any of the preceding embodiments.

The computed tomography apparatus comprises the system with the non-linear inductor, a capacitor and a high-voltage generator. In addition, the CT apparatus comprises an X-ray tube with an electrode, wherein a high-voltage outlet of the high-voltage generator and thus the first connection terminal of the capacitor are connected to the electrode. The resonant operation of the system causes a charging and discharging of the capacitor connected to the electrode. Thus, a charging current of the capacitor is used to charge and discharge intrinsic capacitances of the computed tomography apparatus like capacitances of the electrode, the cables, or the high-voltage generator. Therefore, the square voltage provided by the system is superposed with the high-voltage provided by the high-voltage generator, and the high-voltage applied to the electrode of the X-ray tube is switched between two different high-voltage levels. Further, the computed tomography apparatus or the system can comprise a processing unit configured for controlling the switching of the high-voltage by manipulation of the resonant operation.

According to another aspect of the invention, there is provided a method for high-voltage switching for a computed tomography apparatus. The method comprises the steps of providing the computed tomography apparatus according to the preceding aspect of the invention, and driving a current through the inductor thereby exciting a resonant operation and switching a high-voltage applied to an electrode of an X-ray tube of the computed tomography apparatus.

In the first step of the method, a computed tomography apparatus is provided. This apparatus comprises an X-ray tube and the system according to any of the preceding embodiments. In the second step, a current through the non-linear inductor of the system is excited and driven in a resonance frequency of the system. Thus, essentially a square voltage is applied to the capacitor, which results in high-voltage switching of the voltage applied to an electrode of the X-ray tube of the computed tomography apparatus.

According to another aspect of the invention, there is provided a computer program element, which, when executed on a processing unit, instructs the processing unit to cause the method with the step of driving a current through the inductor of the system according to any of the preceding embodiments thereby exciting a resonant operation and switching a high-voltage applied to an electrode of an X-ray tube of a computed tomography apparatus.

The computer program element can be performed on one or more processing units, which are instructed to cause the method for high-voltage switching for a computed tomography apparatus.

Preferably, the program element is stored in a computed tomography apparatus comprising the system for high-voltage switching and a processing unit carrying out this program element is part of said apparatus.

The computer program element may be part of a computer program, but it can also be an entire program by itself. For example, the computer program element may be used to update an already existing computer program to get to the present invention.

The computer program element may be stored on a computer readable medium. The computer readable medium may be seen as a storage medium, such as for example, a USB stick, a CD, a DVD, a data storage device, a hard disk, or any other medium on which a program element as described above can be stored.

According to another aspect of the invention, there is provided a processing unit configured for executing the computer program element according to the preceding embodiment.

The processing unit can be distributed over one or more different devices executing the computer program element according to the invention.

Thus, the benefits provided by any of the above aspects equally apply to all of the other aspects and vice versa.

In a gist, the invention relates to a system and a method for high-voltage switching for a computed tomography apparatus. The system comprises an oscillating circuit with a non-linear inductor and a capacitor. The inductor and the capacitor are connected in series, and the capacitor is connected to a high-voltage line of a high-voltage power supply. The inductor comprises an inductance that decreases with increasing current through the inductor, such that the inductance of the inductor significantly chances during a resonant operation of the oscillating circuit, thereby providing essentially a square voltage applied to the capacitor. The square voltage modulates the high-voltage of the high-voltage generator thus switching high-voltage levels applied to an electrode of an X-ray tube of a computed tomography system.

The above aspects and embodiments will become apparent from and be elucidated with reference to the exemplary embodiments described hereinafter. Exemplary embodiments of the invention will be described in the following with reference to the following drawings:

DETAILED DESCRIPTION OF EMBODIMENTS

Figure 1:
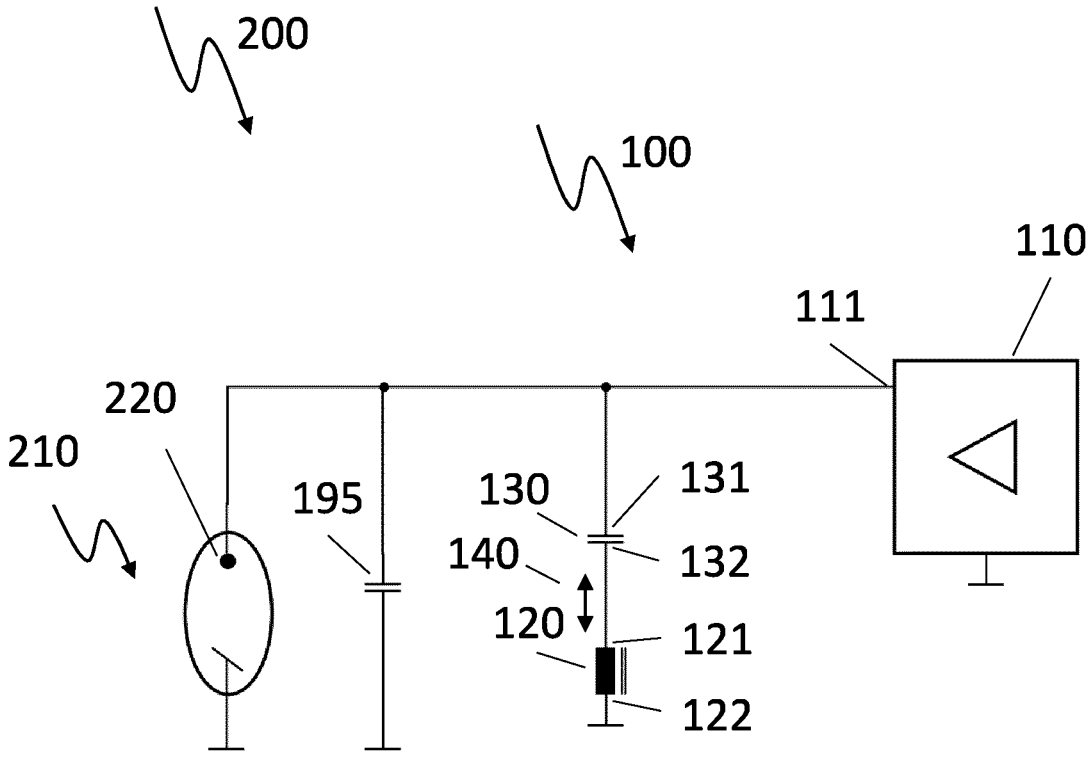
FIG. 1 shows a schematic set-up of a system for high-voltage switching for a computed tomography apparatus according to a first embodiment of the invention.

FIG. 1 shows a schematic set-up of a system 100 for high-voltage switching for a computed tomography apparatus 200 according to a first embodiment of the invention. The components from left to right are the X-ray tube 210 with the electrode 220. A capacitor 195 to ground represents all the capacitances in the generator, the cables etc. A high-voltage generator 110 with a high-voltage outlet 111 is depicted on the right side of the image. The system comprises a LC series circuit shown in the figure, comprising a capacitor 130 and an inductor 120. The capacitor 130 has a first connection terminal 131 and a second connection terminal 132. The inductor 120 has a first connection terminal 121 and a second connection terminal 122. In the resonant operation of the system, a current 140 flows through the LC circuit, in particular through the inductor 120, which is a non-linear inductor. The inductance is highly non-linear. This means that it can have a magnetic core that saturates at or below 500 mA of current through the inductor 120. The relative permeability of a material of the magnetic core may be in the order of 10000 or more. This means, the time at the current amplitude below the saturation level of the magnetic core can be very long in comparison to the time for the high current, where the current is above the saturation level of the magnetic core. The times of low current below the predefined current level 145 are the constant voltage regions of the voltage 150 at the capacitor 130, and at high current, the voltage changes rapidly from one constant voltage region 151 to the other constant voltage region 152. In a simple case, the oscillation of the current 140 may be started using voltage swings by the high-voltage generator 110.

Figure 2A:
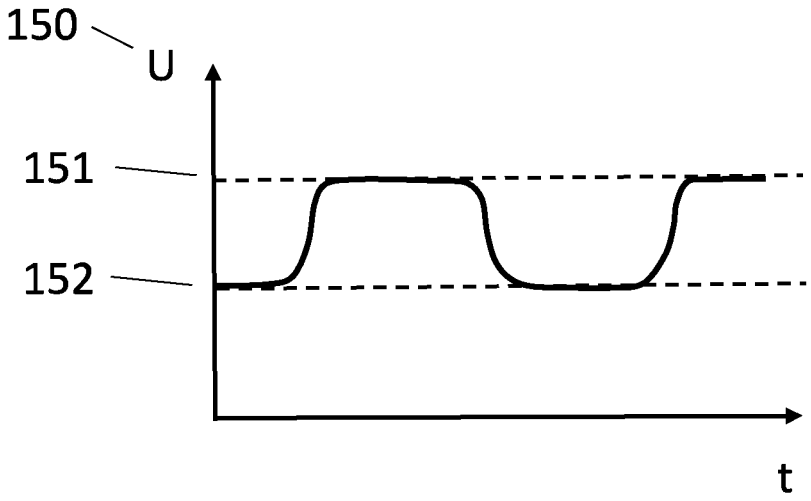
FIG. 2A shows a graph of a square voltage applied at the capacitor over the time.

FIG. 2A shows a graph of a square voltage applied at the capacitor 130 over the time. The voltage applied at the capacitor 130 switches between a first voltage level 151 and a second voltage level 152. The switching takes place at times where the current 140 through the inductor is above the predefined current level 145.

Figure 2B:
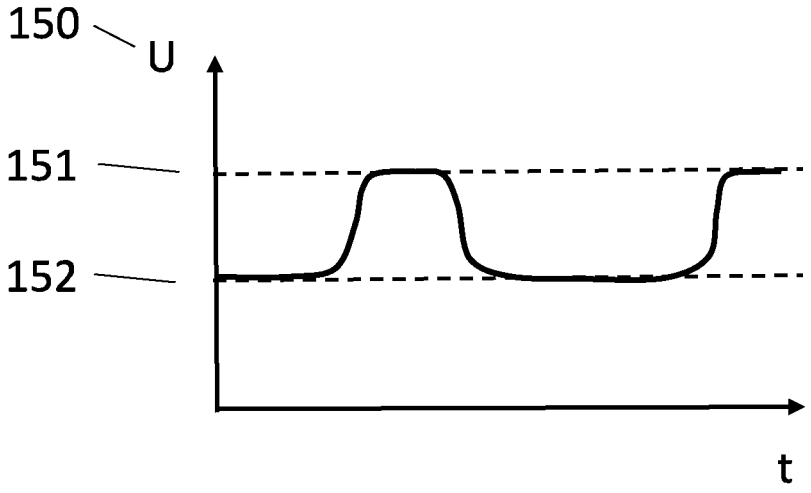
FIG. 2B shows a graph of an asymmetric square voltage applied at the capacitor over the time.

FIG. 2B shows a graph of an asymmetric square voltage applied at the capacitor over the time. The voltage applied at the capacitor 130 switches between a first voltage level 151 and a second voltage level 152. In this figure, the time of the voltage 150 being on the second voltage level 152 is about twice as long as the time of the voltage 150 being on the first voltage level 151. Thus, a duty cycle of the system 100 can be adjusted, if the times for switching the voltage 150 are manipulated by, for example, an asymmetric behavior of the non-linear inductor 120.

Figure 3:
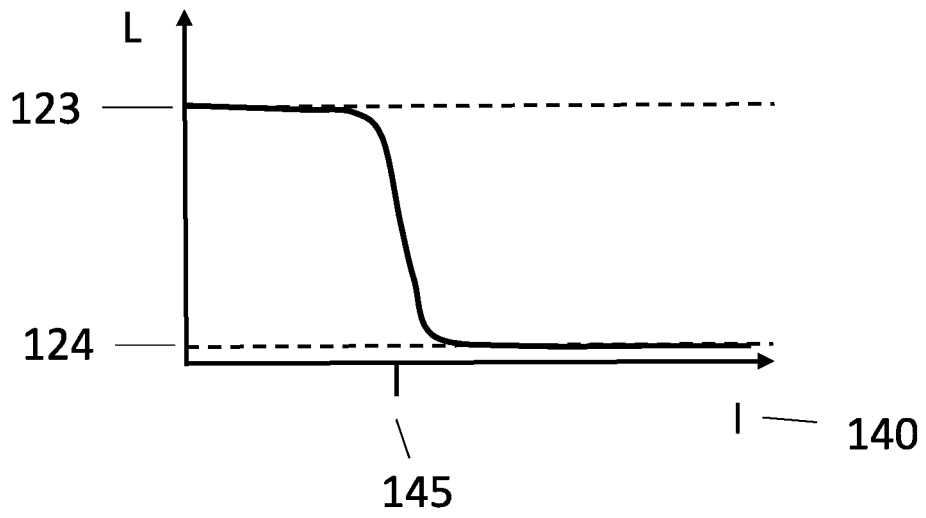
FIG. 3 shows a graph of the inductance of a non-linear inductor over the current through the inductor.

FIG. 3 shows a graph of the inductance of a non-linear inductor 120 over the current 140 through the inductor 120. The inductance L is at a level of a first inductance 123 for the current 140 being smaller than the predefined current level 145. In case the current 140 is greater than the predefined current level 145, the inductance L of the inductor 120 is rapidly decreased and is at a level of a second inductance 124. The ratio of the first inductance 123 to the second inductance 124 can be greater than 100, or even greater than 10000 in preferred embodiments.

Figure 4:
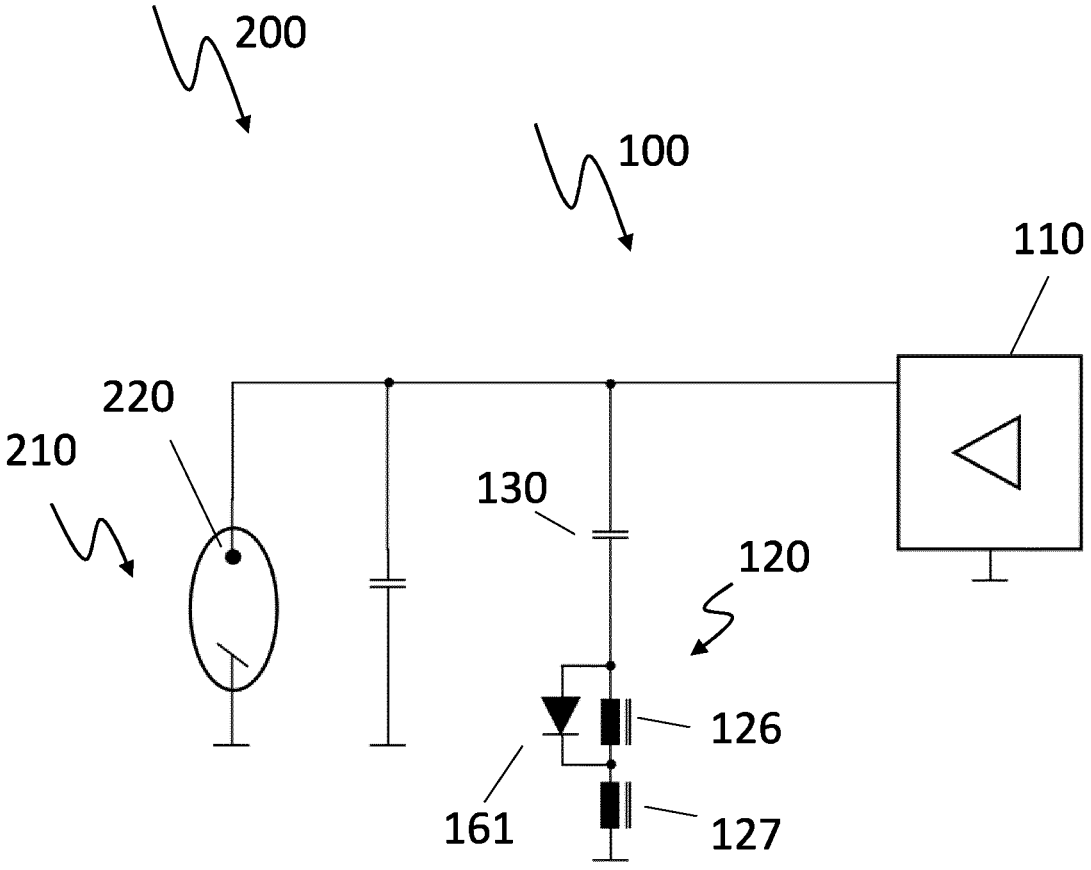
FIG. 4 shows a schematic set-up of a system for high-voltage switching for a computed tomography apparatus according to a second embodiment of the invention.

FIG. 4 shows a schematic set-up of a system 100 for high-voltage switching for a computed tomography apparatus 200 according to a second embodiment of the invention. As the embodiment of the invention shown in FIG. 1 provides only symmetrical voltage swings, which may be not optimal in terms of signal to noise ratio, one possible solution to this problem is shown in FIG. 4. Compared to FIG. 1, in this embodiment of the invention, the inductor 120 is subdivided into a first inductor 126 and a second inductor 127, which are connected in series to each other. A diode 161 is connected in parallel to the first inductor 126, and configured for short-circuiting the first inductor 126 in only one current direction of the current 140. The non-linear inductor is split into two sections and at least one of the sections is bridged by at least one diode. This has the effect that in one direction of current flow, the inductance is larger and the time at constant voltage longer. A voltage-over-time dependency derived from this embodiment is shown in FIG. 2B.

Figure 5:
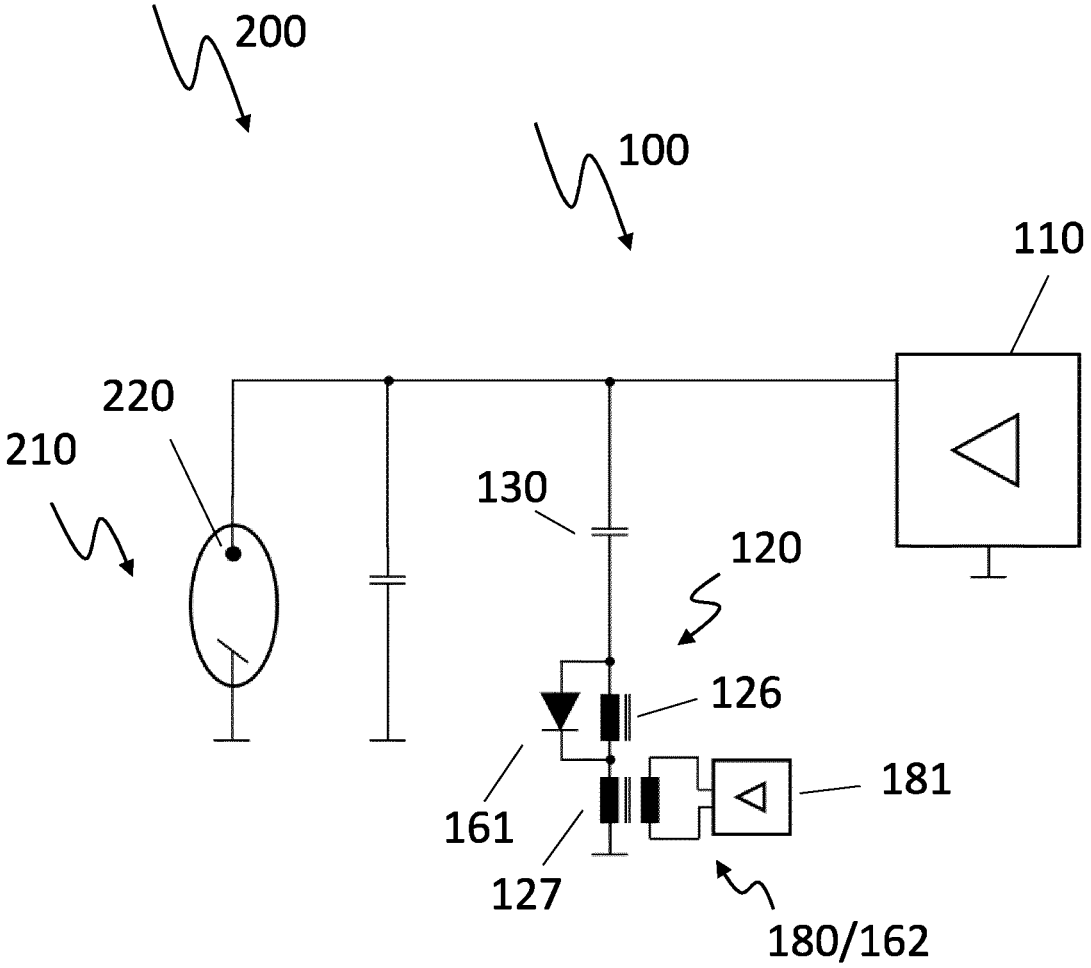
FIG. 5 shows a schematic set-up of a system for high-voltage switching for a computed tomography apparatus according to a third embodiment of the invention.

FIG. 5 shows a schematic set-up of a system 100 for high-voltage switching for a computed tomography apparatus 200 according to a third embodiment of the invention. As it is very inconvenient to excite the oscillation using the high-voltage generator, an amplifier dedicated for generating the oscillating voltage can be added. In this embodiment of the invention, the amplifier 181 is inductively coupled to the resonator, but other coupling modes (capacitive, resistive at various feed point or inductive but using a dedicated transformer ... ) may be used, too. The dedicated amplifier 181 can be used in all the embodiments of the invention. In this embodiment of the invention, an additional driving mechanism 180 comprising an amplifier 181 is shown. The amplifier 181 can drive an alternating current through an inductor of the driving mechanism 180, which can be inductively coupled to the at least one of the inductors of the inductor 120. Thus, the current 140 of the resonant operation can be excited and driven through the inductor 120. However, in embodiments of the invention, this amplifier 181 inductively coupled to the inductor 120 can also be used as biasing device 162 for influencing a saturation level of a magnetic core of the inductor 120. Thus, the amplifier 181 can be used to adjust the frequency of the resonant operation to the exact desired value.

Figure 6:
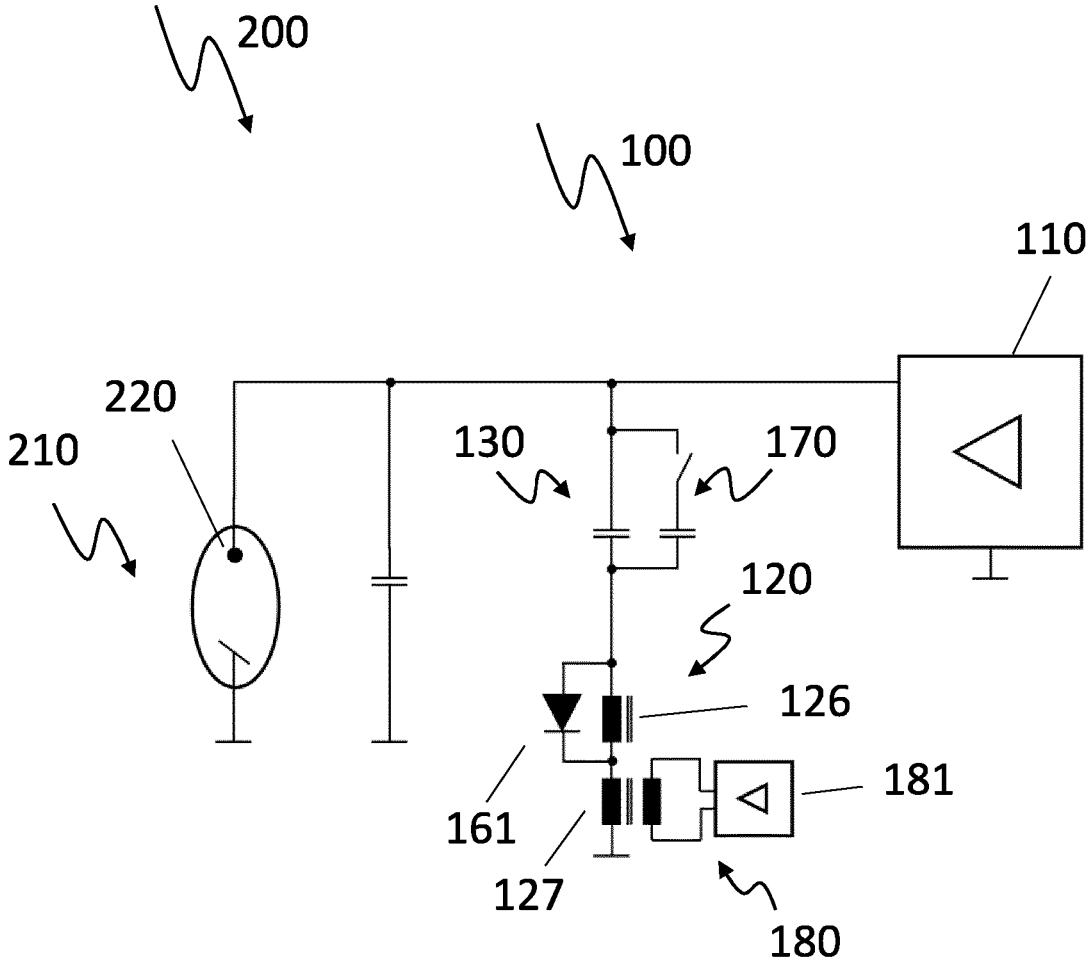
FIG. 6 shows a schematic set-up of a system for high-voltage switching for a computed tomography apparatus according to a fourth embodiment of the invention.

FIG. 6 shows a schematic set-up of a system 100 for high-voltage switching for a computed tomography apparatus 200 according to a fourth embodiment of the invention. As the computed tomography apparatus 200 may have several rotation speeds, the frequency of the resonant operation needs also a coarse adjustment method to change the frequency over a factor of two, for example. This figure shows an embodiment, where the capacitance in the capacitor 130 of the resonant circuit can be adjusted by suitable switches. Other locations with switched or otherwise changed capacitances and inductances are also possible. The switching may have more stages than shown in the drawing allowing for a more precise frequency adjustment. There may be no need for a broader range of adjustment than about two, as for a slower rotation of the X-ray tube, it is always possible to have more than one voltage swing per view. However, technically, it is possible to increase the frequency swing. In this embodiment, the capacitor 130 is divided into two sub-capacitors connected in parallel. One of the parallel branches comprises a switch 170 connected in series to the respective capacitor. Thus, by opening and closing of the switch, the capacitance of the capacitor 130 can be switched between two values. In case both of the sub-capacitors have the same capacitance, the capacitance of the capacitor 130 can be doubled by closing the switch 170.

Figure 7:
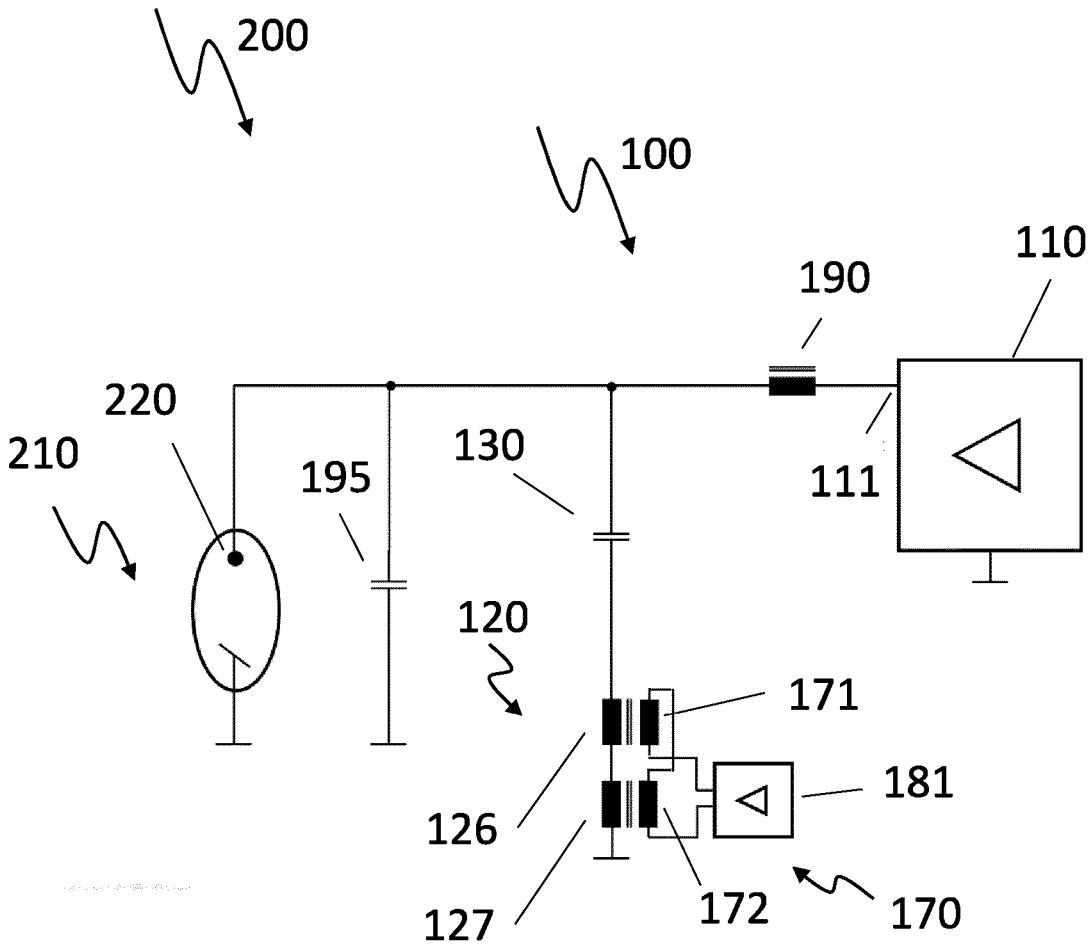
FIG. 7 shows a schematic set-up of a system for high-voltage switching for a computed tomography apparatus according to a fifth embodiment of the invention.

FIG. 7 shows a schematic set-up of a system 100 for high-voltage switching for a computed tomography apparatus 200 according to a fifth embodiment of the invention. In this embodiment, a different approach for steering the resonant operation of the system 100 is depicted. A high-power amplifier 181 is used to modify the saturation level of the inductor 120 in the resonance path. This means, the inductance of the inductor 120 is modified and hence the times for which the voltage is constant. In the figure, the fields of the resonance current in the inductor 120 and the steering current in the first control inductor 171 and the second control inductor 172 of the adjustment mechanism 170 are co-linear and a decoupling is achieved by splitting the inductor 120 in two and driving each one of the first inductor 126 and the second inductor 126 with a current in opposite directions. However, the decoupling can be better, if the magnetic material forms a toroidal structure and the main and steering windings are shaped in a way to magnetize the core material in orthogonal direction. Naturally, the amplifier 181 needs to modulate its current through the kVp cycle to reach the desired effect. In FIG. 7, also an additional smoothing inductor 190 after the high-voltage generator 110 is shown. This smoothing inductor 190 makes the voltage curves more predictable and decreases the capacitance seen by the resonator, hence reduces its designed power handling capability.

Figure 8:
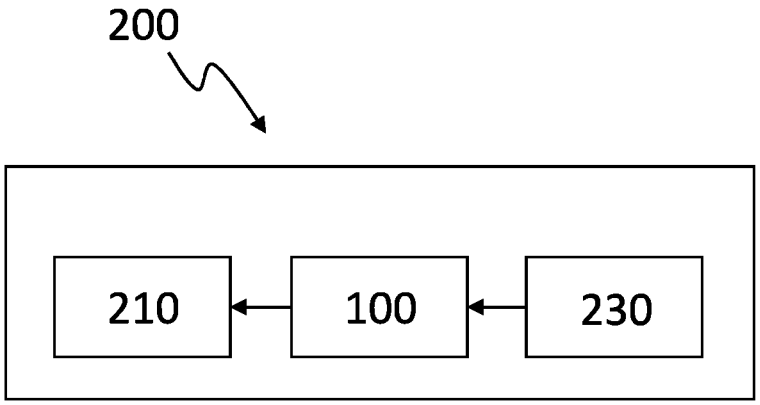
FIG. 8 shows a schematic set-up of a computed tomography apparatus according the invention.

FIG. 8 shows a schematic set-up of a computed tomography apparatus 200 according the invention. The computed tomography apparatus 200 comprises an X-ray tube 210 with an electrode 220, and the system 100 according to any of the preceding embodiments of the invention. The computed tomography apparatus 200 can further comprise a processing unit 230 configured for controlling the high-voltage switching of the system 100.

Figure 9:
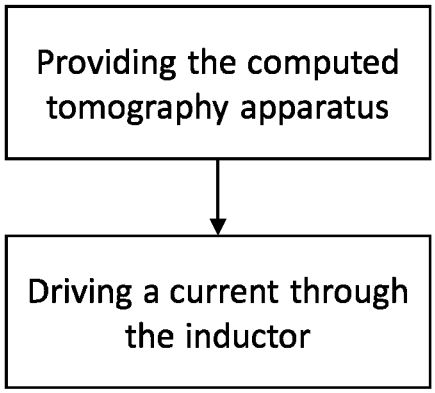
FIG. 9 shows a block diagram of the method for high-voltage switching for a computed tomography apparatus according to the invention.

FIG. 9 shows a block diagram of the method for high-voltage switching for a computed tomography apparatus 200 according to the invention. The method comprises a first step of providing a computed tomography apparatus 200, and a second step of driving a current 140 through the inductor 120 thereby exciting a resonant operation and switching a high-voltage applied to an electrode 220 of an X-ray tube 210 of the computed tomography apparatus 200.

While the invention has been illustrated and described in detail in the drawings and foregoing description, such illustration and description are to be considered illustrative or exemplary and not restrictive. The invention is not limited to the disclosed embodiments. Other variations to the disclosed embodiments can be understood and effected by those skilled in the art in practicing a claimed invention, from a study of the drawings, the disclosure, and the dependent claims.

In the claims, the word "comprising" does not exclude other elements or steps, and the indefinite article "a" or "an" does not exclude a plurality. The mere fact that certain measures are re-cited in mutually different dependent claims does not indicate that a combination of these measures cannot be used to advantage. Any reference signs in the claims should not be construed as limiting the scope.

LIST OF REFERENCE SIGNS

| | |
|---|---|
| **100** | system |
| **110** | high-voltage generator |
| **111** | high-voltage output |
| **120** | inductor |
| **121** | first connection terminal of inductor |
| **122** | second connection terminal of inductor |
| **123** | first inductance |
| **124** | second inductance |
| **126** | first inductor |
| **127** | second inductor |
| **130** | capacitor |
| **131** | first connection terminal of capacitor |
| **132** | second connection terminal of capacitor |
| **140** | current through inductor |
| **145** | predefined current level |
| **150** | voltage at capacitor |
| **151** | first voltage level |
| **152** | second voltage level |
| **161** | diode |
| **162** | biasing device |
| **170** | adjustment mechanism |
| **171** | first control inductor |
| **172** | second control inductor |
| **180** | driving mechanism |
| **181** | amplifier |
| **190** | smoothing inductor |
| **195** | intrinsic capacitance |
| **200** | computed tomography apparatus |
| **210** | X-ray tube |
| **220** | electrode |
| **230** | processing unit |

The invention claimed is:

1. A system for high-voltage switching for a computed tomography apparatus, the system comprising:

a high-voltage generator;

an inductor having a non-linear inductance; and a capacitor;

wherein a first connection terminal of the capacitor is communicationally connected to the high-voltage generator;

wherein a second connection terminal of the capacitor is communicationally connected to a first connection terminal of the inductor for employing a resonant operation of a current through the inductor;

wherein the inductor is configured for providing a reduction of the non-linear inductance with an increasing current through the inductor; and wherein the inductor is configured for providing the reduction of the non-linear inductance at a predefined current level of the current through the inductor below a maximum value of the current of the resonant operation.

2. The system according to claim 1, wherein the inductor comprises a magnetic core that is configured for magnetically saturating at the predefined current level.

3. The system according to claim 1, wherein the inductor is configured for providing a first inductance in case the current through the inductor is below the predefined current level and a second inductance in case the current through the inductor is above the predefined current level, and wherein the second inductance is smaller than the first inductance by a factor of at least 100.

4. The system according to claim 1, wherein the system is configured for providing in the resonant operation a voltage applied at the capacitor that is essentially constant at a first voltage level or at a second voltage level in case the current through the inductor is below the predefined current level, and wherein the voltage applied at the capacitor rapidly changes from the first voltage level to the second voltage level or from the second voltage level to the first voltage level in case the current through the inductor is above the predefined current level.

5. The system according to claim 1, wherein the inductor is configured to provide a non-linear inductance, wherein a first dependency of the inductance from the current in a first direction of the current though the inductor is different from a second dependency of the inductance from the current in a second direction of the current through the inductor, wherein the first direction is opposite to the second direction, and/or wherein the system is configured for providing a voltage applied to the capacitor that is essentially an asymmetric square voltage.

6. The system according to claim 5, wherein the inductor comprises a first inductor having a non-linear inductance, a second inductor having a non-linear inductance and connected in series to the first inductor, and a diode configured to act as rectifier and/or connected in parallel to the first inductor or to the second inductor.

7. The system according to claim 5, wherein the system comprises a biasing device configured to expose the inductor to an external magnetic field or wherein the system comprises a biasing circuit configured to cause a DC bias current through the inductor.

8. The system according to claim 1, wherein the system comprises an adjustment mechanism configured to adjust a resonance frequency of the resonant operation.

9. The system according to claim 1, wherein the inductor comprises a first inductor having a non-linear inductance; and a second inductor having a non-linear inductance and connected in series to the first inductor; wherein the system comprises a first control inductor inductively coupled to the first inductor; and a second control inductor inductively coupled to the second inductor; wherein the system is configured to provide a first control current in the first control inductor and a second control current in the second control inductor, and wherein the first control current has a same amperage and an opposite direction to the second control current.

10. The system according to claim 1, wherein the system comprises a driving mechanism configured to excite the resonant operation.

11. The system according to claim 10, wherein the driving mechanism comprises switching of the high-voltage generator, or wherein the driving mechanism comprises an amplifier inductively coupled to the inductor or capacitively coupled to the capacitor.

12. The system according to claim 1, further comprising a smoothing inductor, wherein the first connection terminal of the capacitor is connected to a high-voltage output of the high-voltage generator via the smoothing inductor.

13. A method for high-voltage switching for a computed tomography apparatus, the method comprising:

providing the system according to claim 1;

driving a current through the inductor thereby exciting a resonant operation and switching a high-voltage applied to an electrode of an X-ray tube of the system.

* * * * *